United States Patent [19]

DeVicaris

[11] 4,072,857

[45] Feb. 7, 1978

[54] ARTIFICIAL TREE

[76] Inventor: Guy A. DeVicaris, 957 Bristol Pike, A-6, Andalusia, Pa. 19020

[21] Appl. No.: 684,753

[22] Filed: May 10, 1976

[51] Int. Cl.[2] ..... F21S 1/12

[52] U.S. Cl. ..... 362/123; 362/252; 362/431

[58] Field of Search ..... 240/52.1, 81 A, 73 QD, 240/81 H, 2 SL, 10 T, 53, 81 C, 81 BC, 81 BE, 153, 10 Q; 339/14 T

[56] References Cited

U.S. PATENT DOCUMENTS

| | | | |
|---|---|---|---|
| 1,646,808 | 10/1927 | Benjamin | 240/73 QD |
| 2,188,529 | 1/1940 | Corina | 240/10 Q |
| 2,201,045 | 5/1940 | Lundstron | 240/10 T X |
| 2,230,028 | 1/1941 | Del Camp | 339/14 T |
| 2,572,382 | 10/1951 | Peterson | 240/10 T |
| 2,818,497 | 12/1957 | Alden | 240/52.1 X |
| 2,863,038 | 12/1958 | Lombardo | 240/73 QD |
| 2,988,632 | 6/1961 | Curtis | 240/52.1 X |
| 3,065,437 | 11/1962 | Del Camp | 339/14 T |
| 3,617,732 | 11/1971 | Fisher | 240/10 Q |
| 3,619,602 | 11/1971 | Wilde | 240/73 QD X |

*Primary Examiner*—Edna M. O'Connor
*Attorney, Agent, or Firm*—Steven H. Markowitz

[57] ABSTRACT

The present invention is directed to an artificial tree capable of conducting an electric current which comprises a base, an artificial trunk connected to the base and having a first electrical conductor extending therewithin and having at least one first connector electrically connected to the first electrical conductor, the first connector extending through an outside wall of the trunk and at least one artificial limb having a second electrical conductor extending therewithin and a second connector electrically connected to the second electrical conductor, wherein the first connector is a first female-type electrical connector which comprises first narrow slits, and wherein the second connector is a first male-type electrical connector comprising first narrow prongs corresponding in shape to the slits such that said limb can be detachably and electrically connected to said trunk. The male-type electrical connector including an auxiliary structural support and the female-type electrical connector includes a corresponding auxiliary opening into which the structural support can be insert.

21 Claims, 5 Drawing Figures

ARTIFICIAL TREE

BACKGROUND OF THE INVENTION

The use of artificial trees, and especially artificial Christmas trees, has become very popular. There are a number of reasons why it is desirable to use an artificial tree instead of a natural one. Natural trees are extremely varied in physical characteristics, e.g., size, shape, fullness, etc. and thus the selection of a tree with aesthetically pleasing physical characteristics is often a difficult task. On the other hand, artificial trees are uniformly made with physical characteristics which are pleasing to the eye. Also, artificial trees are durable and can be used repeatedly over a long period of time while natural trees are normally discarded or planted (depending on whether or not their root systems have been removed) after their first use. In addition, artificial trees are maintenance-free as compared to natural trees. Furthermore, artificial trees can be made of fire retardant materials for safe and comparatively clean use. Also, ecological considerations dictate the use of an artificial tree for obvious reasons.

Indeed, artificial trees have been developed to meet the popular demand therefor. U.S. Pat. No. 2,857,506 to Minteer discloses an artificial tree in which the branches are permanently connected to the trunk by pliable cables such that the branches can allegedly be conveniently folded against the trunk for storage purposes. However, the Minteer artificial tree is considered to have certain drawbacks. To provide fullness for a realistic appearance, it will readily be appreciated that a large number of limbs and small side branches must be provided. However, when folded for storage, the limbs and side branches will stack against each other resulting in an artificial tree which is cumbersome to store. Also, since the limbs are permanently connected to the tree trunk, detachment of the same for repair or replacement would be extremely difficult, if not almost impossible. In addition, since the electrical wires for the limbs run adjacent to and in contact with the pliable cables, the repeated bending of the cables for storage and use will inevitably weaken and possibly break the electrical wires, creting a hazardous condition. Also, the pliable cables and perhaps the electrical wires running through the limbs are the only elements providing structural support to the limbs such that if the limbs are too long or overloaded (for example, by decorations) the limbs would probably droop.

U.S. Pat. No. 3,603,780 to Lu discloses an artificial tree which features limbs pivotally connected to a trunk for easy folding and tensioned electrical wiring and auxiliary sleeve members for the limbs to impart structural rigidity to the tree. However, the pivotal connection of the limb to the tree and the connection of the electrical limb wires and trunk wies are relatively permanent connections in the sense that it would be difficult to detach a limb from the trunk for decorative, repair or replacement purposes. Also, it would appear that the tensioning of the wires for imparting structural rigidity to the tree and the repeated bending of the wires would weaken, and eventually break the wires.

U.S. Pat. No. 3,617,732 to Fisher discloses an artificial tree which, among other things, features detachable limbs for easy storage. Fisher discloses a trunk having female-type sockets each of which has electrical wires protruding from a back wall thereof. The limbs each have what the reference refers to as a male-type electrical connector which fits snugly into a female-type socket on the trunk. The protruding wires in the female-type socket are, in turn, received in corresponding openings in the male-type connector. The female-type sockets can also receive a decorative light instead of a limb. From a safety standpoint, these female-type sockets with protruding electrical wires are seen to be potentially hazardous. For example, a child could insert a finger or conductive object into the socket, contact the protruding wires, and receive an electrical shock. Also, other than the electrical connectors, the limbs have no structural support, such that the larger limbs, especially if decorated, would apparently droop. In addition, aligning the wires in the recessed female-type socket with the slot-like openings of the branch would appear to be both difficult and damaging to the wires.

SUMMARY OF THE INVENTION

The present invention is related to a novel improved artificial tree, capable of conducting an electric current, which overcomes the drawbacks related to prior art electrical artificial trees.

The artificial tree, according to one feature of the present invention, comprises trunk means having at least one female-type electrical connector with narrow slit-shaped openings and at least one limb means having a male-type electrical connector with narrow prong means corresponding in shape to said openings in said female-type connector such that said limb means can be detachably and electrically connected to said trunk means. The terminology "electrically connected" is intended to mean that an electrical current passed along the trunk means will also pass along the limb means via the electrical connectors. The terminology "narrow slit" is intended to mean an opening sized sufficiently small to prevent the insertion of a child's finger therein. Thus, it can be seen that a critical safety feature is added to electrical artificial trees.

The artificial tree, according to another feature of the present invention, comprises auxiliary structural support means provided on one of a corresponding pair of electrical connectors, and a corresponding auxiliary opening on the other of said pair to receive the support means. When provided on the male-type connector, the elongated structural support means preferably extends in the same general direction as do the prong means. It is preferred that the structural support means extends beyond the prong means. The structural support means is received in a corresponding auxiliary opening provided in the female-type electrical connector in the trunk. In addition to providing strength to the limbs to prevent the drooping thereof, the structural support means will be hidden from view in use, avoiding any detraction from an otherwise neat appearance of the assembled tree. The support means can also be provided for the tree trunk as disclosed below.

According to still a further feature of the present invention, the above-noted auxiliary structural support means can serve as a guide means for easy alignment of the female-type electrical connector and male-type electrical connector. This is accomplished by shaping the auxiliary structural support means and the corresponding auxiliary opening such that the structural means can be inserted in the opening only when the electrical connectors are properly aligned.

These and other objects, features and advantages of the present invention will become more apparent from the following description when taken in connection with the accompanying drawings which show, for purposes of illustration only, several embodiments in accordance with the present invention, and wherein.

Figure 1:
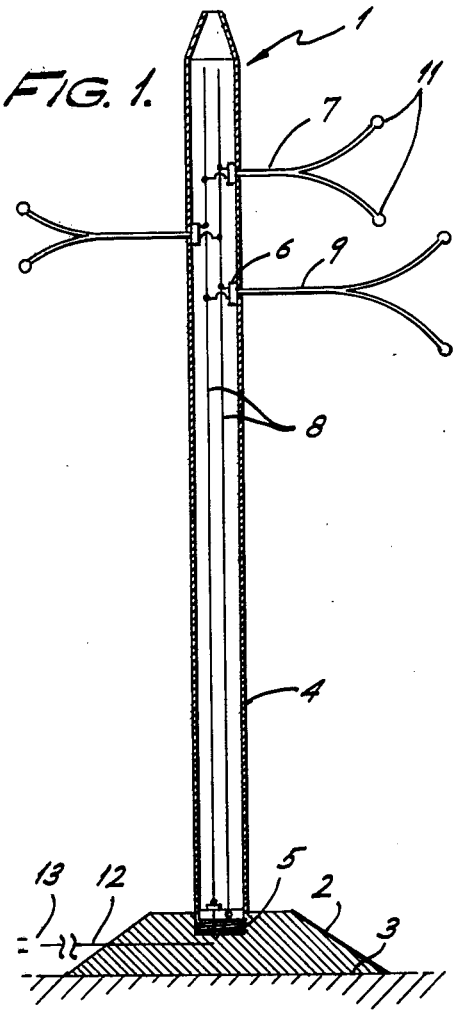
FIG. 1 is a vertical sectional view of an assembled artificial tree constructed according to the present invention.

Referring now to the drawings, wherein the same reference numeral is used throughout to indicate the same element, FIG. 1 illustrates an assembled artificial tree in accordance with the present invention. Element 2 is a support base for the tree which support base can be of any known construction. For example, the base 2 can have a flat bottom 3 for resting securely on a flat surface. The base 2 and trunk 4 are constructed for easy interconnection, for example by providing a threading at one end of the trunk and a corresponding threading in passage 5. Utilizing this arrangement, the trunk can be screwed into passage 5 for easy assembly of the tree, or it can be unscrewed for easy disassembly thereof. The base 2 could also, for example, be provided with an upstanding threaded protrusion resembling a screw and the trunk could be provided with a threaded passageway for receiving the screw-like protrusion. In addition, a friction-type connector could be arranged between the trunk and base. Also, the base and trunk could be integral.

Trunk 4 is elongated and is provided along its length with at least one female-type electrical connector 6. When the tree is assembled, each electrical connector will preferably have a limb 7 inserted therein. The numeral 8 is schematically designates electrical conductors, in the form of wires, extending within trunk 4 which conductors are electrically connected with each female-type connector 6. Electrical conductors 9, preferably in the form of conductive wires, extend within limbs 7 and are electrically connected with male-type electrical connectors 10 and decorative lights 11. Electrical conductor 12 having a conventional plug 13 at one end thereof, is electrically connected to electrical conductor 8 within trunk 4. Thus, it can be seen that when plug 13 is plugged into a source of electricity such as a conventional electrical outlet, electric current will travel through conductor 12, through conductors 8 within the trunk 4 and, via the connection of electrical connector 6 along the trunk with electrical connector 10 at one end of the limb 7, through the limb to the decorative lights 11. By making the base 2, trunk 4 and limbs 7 of plastic material, a particularly safe, durable and inexpensive artificial tree can be realized for obvious reasons. A molded polymeric material would be particularly suitable as this material with the electrical conductors embedded therewithin.

Figure 2:
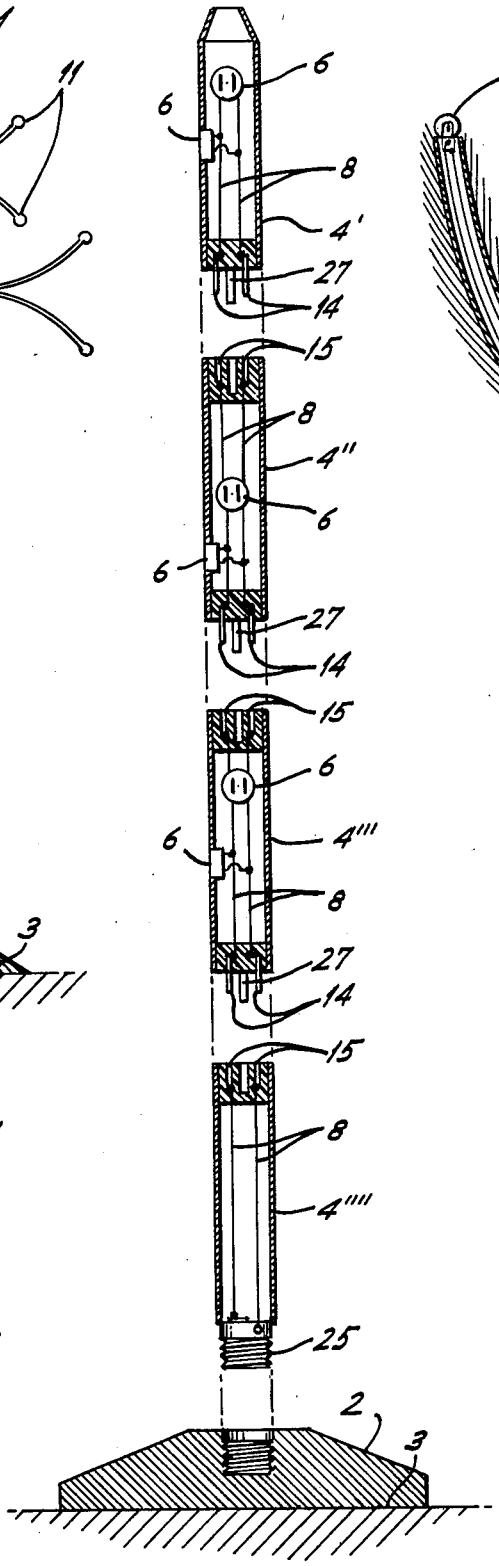
FIG. 2 is a side elevational view of a sectional artificial tree trunk made in accordance with the present invention.

With particular reference to FIG. 2, further details of the trunk will now be described. Although the trunk can take the form of a single article, it is preferred that it be sectional, as shown at 4',4'',4''' and 4'''', for storage purposes. This can be easily accomplished, for example, by providing electrically conductive attaching means such as prongs 14 at the bottom end of the sections 4',4'' and 4'''. Although the bottom end of 4'''' could also be provided with prongs 14 it is shown as having electrically conductive screw means 25. The upper end of each section is provided with electrical receptacle means 15 corresponding in shape to prongs 14. As illustrated in FIG. 2, electrical conductors 8 electrically connect the lower attaching means 14 of each section with each female-type connector 6 and with the upper connecting means 15 thereof, such that when the tree is assembled the tree will be electrically conductive. If desired, the limbs 7 can also be sectional in a manner similar to trunk 4.

Figure 5:
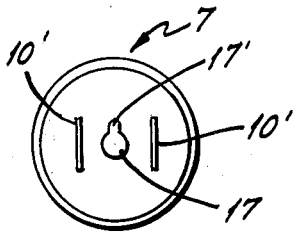
FIG. 5 is an end view of the artificial tree limb taken along sight line A—A in FIG. 4.

The limb 7 can be provided with artificial needles 16 to simulate a Christmas tree. At one end of limb 7 is a male-type electrical connector 10 shown in the form of a typical electrical plug having narrow prongs 10'. In addition to electrical connector 10, the limb is provided with auxiliary structural support member 17. The support member 17 should extend in the same general direction as prongs 10' and, preferably, extends beyond (is longer than) the outer ends of prongs 10'. While the support member shown is generally cylindrical in shape, it could have any one of various shapes. For example, it could be flat and L-shaped or flat T-shaped. The support member is preferably of an "eccentric" cross-sectional shape, as illustrated in FIG. 5, for reasons which will later become apparent. The "eccentric" shape illustrated in FIG. 5 is achieved by providing nub 17' either along the entire length of the member 17 or along a portion thereof.

Figure 3:
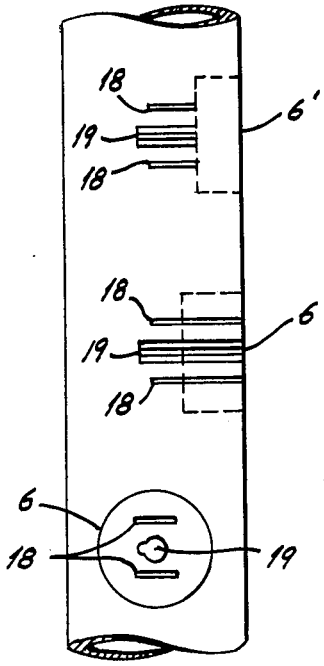
FIG. 3 is a sectional view of the tree trunk depicting the details of an electrical connector illustrated in FIG. 2.

The female-type electrical connector 6 is illustrated in detail in FIG. 3. This connector can either be flush with the trunk surface as shown at 6, or it can be recessed as shown at 6'. The connector 6 or 6' comprises narrow slit-shaped openings 18 for receiving prongs 10' on the limb and auxiliary opening 19 for receiving auxiliary support member 17. The shape of auxiliary opening 19 should correspond closely to the eccentric shape of support member 17. Since the support member is longer than the electrical prongs 10, when connecting the limb 7 to trunk 4, support member 17 will contact the surface of female-type connector 6 first, keeping prongs 10' away from the surface until member 17 and auxiliary opening 19 are properly aligned. Once they are properly aligned, support member 17 will slide into opening 19 permitting insertion of prongs 10' into openings 18 to establish an electrical connection between wires 8 and 9. To prevent the accidental insertion of member 17 into one of the electrical openings 18, the member is made either of a different shape than are the openings or of a larger cross-sectional area. Of course, the structural support member 17 could be provided on the female-type connector for insertion into an auxiliary opening in said male-type electrical connector on the limb.

Figure 4:
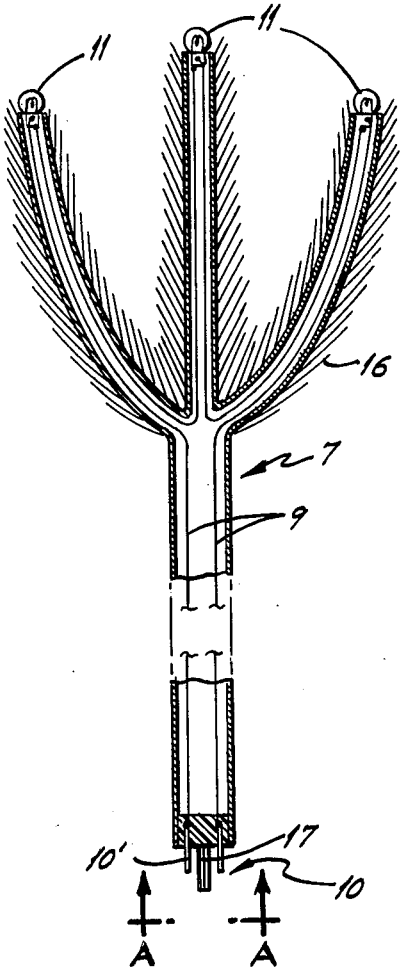
FIG. 4 is a plan view of an artificial tree limb made according to the present invention.

Assuming the subject artificial tree has been disassembled, it would be assembled for use as follows. If the trunk is sectional as illustrated in FIG. 4, the various section 4',4'',4''' and 4'''' are interconnected. The thus assembled trunk 4 is connected to base 2, provided the base and trunk are detachable. Next, the limbs are connected to the trunk via electrical connectors 6 and 10. If desired, auxiliary decorations are placed on the tree. Finally, the plug 13 is connected to an electrical source to light up the decorative lights 11. By simply reversing these illustrative steps, the tree can be easily disassembled for storage.

If the tree trunk is sectional, section auxiliary support members 27 can also be provided for at least one section.

While several specific embodiments of the present invention have been illustrated, it should be understood that many changes and modifications thereof could be made without departing from the spirit of the invention as defined by the appended claims.

I claim:

1. An artificial tree capable of conducting an electric current comprising:

base means;

artificial trunk means connected to said base means and having first electrical conductor means extending therewithin and further having at least one first connector means electrically connected to said first electrical conductor means, said first connector means extending through an outside wall of said trunk means; and at least one artificial limb means having second electrical conductor means extending therewithin and second connector means electrically connected to said second electrical conductor means;

wherein said first connector means is a first female-type electrical connector comprising first narrow slit means, wherein said second connector means is a first male-type electrical connector comprising first narrow prong means corresponding in shape to said slit means such that said limb means can be detachably and electrically connected to said trunk means, wherein one of said first female-type electric connector and said first male-type electric connector is provided with first auxiliary structural support means, and wherein the other of said connectors is provided with first auxiliary opening means corresponding in shape with said first structural support means such that said structural support means can be inserted into said first opening means in use.

2. An artificial tree according to claim 1, wherein each of said artificial limb means is provided with at least one light bulb socket means for receiving a light bulb.

3. An artificial tree according to claim 2, wherein said socket means is electrically connected to said second electrical conductor means.

4. An artificial tree according to claim 1, wherein said trunk means comprises a plurality of detachable sections.

5. An artificial tree according to claim 4, wherein each of said detachable sections has section electrical connector means for electrical interconnection of said sections.

6. An artificial tree according to claim 5, wherein at least one of said section electrical connector means is provided with section auxiliary structural support means, and wherein at least another of said sections is provided with a section auxiliary opening for receiving said section auxiliary structural support means in use.

7. An artificial tree according to claim 6, wherein said section electrical connector means each comprises a section female-type electrical connector provided at one end of said sections with narrow slit-like openings and a section male-type electrical connector at another end thereof with narrow prong means such that said sections are detachably connected by inserting the male-type connector of a first section into the female-type connector of a second section.

8. An artificial tree according to claim 7, wherein said first structural support means and said first opening means have an eccentric cross-sectional shape such that said first structural support means can be inserted into said first opening means only when said first narrow slit means and said first narrow prong means are properly aligned.

9. An artificial tree according to claim 8, wherein said first support means is provided on said first male-type electric connector.

10. An artificial tree according to claim 7, wherein said section auxiliary structural support means and said section auxiliary opening are eccentric in shape such that they can be interconnected only when said section female-type connector and said section male-type connector are properly aligned.

11. An artificial tree according to claim 10, wherein said first structural support means and said first opening means have an eccentric cross-sectional shape such that said first structural support means can be inserted into said first opening means only when said first narrow slit means and said first narrow prong means are properly aligned.

12. An artificial tree according to claim 11, wherein said first support means is provided on said first male-type electric connector.

13. An artificial tree according to claim 6, wherein said first structural support means and said first opening means have an eccentric cross-sectional shape such that said first structural support means can be inserted into said first opening means only when said first narrow slit means and said first narrow prong means are properly aligned.

14. An artificial tree according to claim 13, wherein said first support means is provided on said first male-type electric connector.

15. An artificial tree according to claim 1, wherein said first structural support means and said first opening means have an eccentric cross-sectional shape such that said first structural support means can be inserted into said first opening means only when said first narrow slit means and said first narrow prong means are properly aligned.

16. An artificial tree according to claim 15, wherein said first narrow prong means and said first auxiliary structural support means extend in the same general direction and wherein said first auxiliary structural support means is longer than said first narrow prong means.

17. An artificial tree according to claim 16, wherein said first support means is located between said first narrow prong means and wherein said first opening means is located between said first narrow slit means.

18. An artificial tree according to claim 15, wherein said first support means is located between said first narrow prong means and wherein said first opening means is located between said first narrow slit means.

19. An artificial tree according to claim 1, wherein said first support means is provided on said first male-type electric connector.

20. An artificial tree according to claim 19, wherein said first support means is located between said first narrow prong means and wherein said first opening means is located between said first narrow slit means.

21. An artificial tree according to claim 1, wherein said first narrow prong means and said first auxiliary structural support means extend in the same general direction and wherein said first auxiliary structural support means is longer than said first narrow prong means.

* * * * *